United States Patent [19]

Fuss

[11] 4,200,406

[45] Apr. 29, 1980

[54] MULTIPLE-USE JOINT CONNECTOR

[76] Inventor: Otto Fuss, Läufelsberg, 7583 Ottersweier, Fed. Rep. of Germany

[21] Appl. No.: 806,144

[22] Filed: Jun. 13, 1977

[30] Foreign Application Priority Data

Jun. 15, 1976 [DE] Fed. Rep. of Germany ..... 2626716

[51] Int. Cl.[2] ..... E04H 12/06

[52] U.S. Cl. ..... 403/231; 52/648; 403/171; 403/217

[58] Field of Search ..... 403/231, 170, 171, 172, 403/217, 405, 406; 52/648

[56] References Cited

U.S. PATENT DOCUMENTS

| | | | |
|---|---|---|---|
| 2,931,129 | 4/1960 | Boniface | 403/231 X |
| 3,333,875 | 8/1967 | Tracy | 52/648 X |
| 3,740,084 | 6/1973 | Tellberg | 403/171 |
| 3,874,148 | 4/1975 | Kato | 403/217 |
| 3,988,872 | 11/1976 | Adamson et al. | 403/217 |
| 4,072,433 | 2/1978 | Veyhl | 403/405 X |

FOREIGN PATENT DOCUMENTS

| | | | |
|---|---|---|---|
| 2509768 | 9/1976 | Fed. Rep. of Germany | 403/231 |
| 611480 | 10/1960 | Italy | 403/172 |

*Primary Examiner*—Mervin Stein

*Attorney, Agent, or Firm*—Becker & Becker, Inc.

[57] ABSTRACT

A multiple-use joint connector of plastic, sheet metal, wood, etc., particularly for roof structures of greenhouses, smelting plants, and the like. Two sleeves are arranged at an angle to one another for the insertion of rafters therein. These sleeves are connected by connecting elements which together with the sleeves define an opening, the axis of the passage of which is perpendicular to the longitudinal direction of the sleeves. This opening is provided for the ridge beam or board. The sleeves are open at both ends. The openings between the sleeves are formed by the end edges of those side walls of the sleeves which face one another, and extend beyond the width of the sleeves by extensions of flanges arranged on the sleeves. Additional openings which are aligned with one another and have a cross section at least as large as that of the beam which is to be inserted therethrough, are arranged in the side walls of the sleeves and/or of the extensions thereof which bridge the space between the sleeves.

11 Claims, 3 Drawing Figures

MULTIPLE-USE JOINT CONNECTOR

The present invention relates to a multiple-use joint connector of plastic, sheet metal, wood, etc., according to which two sleeves are arranged at an angle to one another for insertion of rafters therein. These sleeves are connected by connecting elements which together with the sleeves define an opening, the axis of the passage of which is perpendicular to the longitudinal direction of the sleeves. This opening is provided for the ridge beam or board. This connector may be used to make roof structures, especially for greenhouses, smelting plants, etc.

A structure is known which has three openings in the form of sleeves into which the beams which are to be used as rafters and ridge beam may be inserted. The axis of passage of the opening which is intended for the ridge beam and is arranged between the two sleeves provided for the rafters is perpendicular to the longitudinal direction of the two other openings. The drawback of this connector consists in that only three beams can be connected with one another at this junction, while in many instances more beams or similar parts must be connected with one another at such a junction. A further drawback consists in that the angle between the sleeves for the rafters cannot be adjusted. It was therefore proposed to arrange the opening for the ridge beam in a round part provided with outer teeth and respectively to provide a half bushing with inner teeth on the sleeves for the rafters. The three parts are connected with one another in such a way that the bushings are successively placed on the rafter openings. Then the part with the ridge beam opening is inserted into these bushings, in which connection the teeth on the three parts fit into each other. The angle which the two rafters form with one another is then fixed. This heretofore known device, however, has the drawback that due to the complicated bushing arrangement, the desired strength or rigidity cannot be achieved. In addition, the manufacture of the three parts is quite involved and expensive.

It is an object of the present invention to avoid the drawbacks of the heretofore known devices and to produce a connector which is relatively easy to install and is also relatively simple to make.

It is a further object of the present invention to offer numerous possibilities for the arrangement of the beams or rafters with regard to one another.

These objects and other objects and advantages of the invention will appear more clearly from the following specification in connection with the accompanying drawings, in which.

The joint connector pursuant to the present invention is characterized primarily in that the sleeves which form the rafter openings are open at both ends; in that the opening between the sleeves is formed by the end edges of those side walls of the sleeves which face one another and extend beyond the width of the sleeves by extensions of the flanges arranged on the sleeves; and in that additional openings,, which are aligned with one another and have a cross section of the beam which is to be inserted therethrough, are arranged in the side walls of the sleeves and/or of the extensions thereof which bridge the space between the sleeves.

It is expedient that that edge of the upper sleeve wall which faces the opening be offset relative to the corresponding edges of the side walls.

The advantage of the connector according to the present invention consists primarily in that one single piece is provided and offers possibilities for different arrangements of the beams, so that a user of this part may use it in the respective most favorable form. In spite of the above, the single piece pursuant to the present invention has no weak spots since there is no need to manufacture the piece from several individual parts; in addition, the danger with heretofore known multi-part designs of losing individual parts is avoided. Furthermore, this piece, for example of plastic, can be molded in a single step without the necessity for complicated forms or molds.

Figure 1:
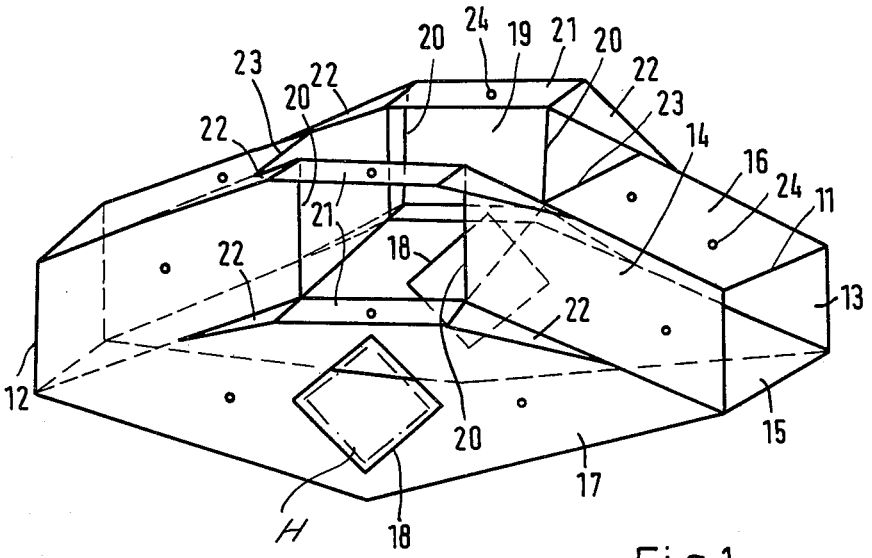
FIG. 1 shows a joint connector pursuant to the present invention according to which the rafters form an angle of 130° with one another.

Referring now to the drawings in detail, the two sleeves 11 and 12 of FIG. 1 are arranged in such a way that if rafters are inserted into the openings 13 they form an angle of 130° with each other. Each sleeve 11 and 12 is formed by two side walls 14, a lower wall 15, and an upper wall 16. The side walls 14 extend as the extension 17, in which are arranged openings 18 having a cross section corresponding to the bar or beam which is to be inserted therethrough. The openings 18 in the two extensions 17 are aligned with one another. The sleeves 11 and 12 are open at both ends.

Between the two sleeves 11 and 12 is an opening 19 which is provided for the ridge beam or board. This axis of passage of the opening 19 is perpendicular to the longitudinal direction of the sleeves. The opening 19 is formed on the one hand by the end edges 20 of the side walls 14 of the sleeves 11 and 12, and on the other hand by flanges or webs 21 which extend beyond the width of the sleeves 11 and 12. The extensions 22 of the flanges 21 are arranged on the sleeves. The edge 23 of the upper sleeve wall 16 facing the opening 19 is offset with regard to the corresponding edges 20 of the side walls 14 of the sleeves.

To use this joint connector, beams as rafters may be inserted into the openings 13 of the sleeves 11 and 12. Since these sleeves 11 and 12 are open at both ends and the edge 23 of the upper sleeve wall 16 is set back far enough, the rafters inserted into the openings 13 may also be pushed through the openings 13 so that one rafter projects above the joint connector on the other side. As a result, of course, the opening 19 is blocked. However, a ridge beam may then be inserted into the openings 18. If a beam is inserted into the sleeves 11 and 12 to about the edges 20, then the ridge beam may be inserted directly into the opening 19 and a second ridge beam may be inserted into the openings 18, whereby the supporting capacity of the ridge beam may be doubled. Nail holes 24 are provided in the side walls 14 and 15 as well as in the flanges 21. Nails can thus be nailed through these nail holes 24 into the beams, so that a firm connecton between beam and joint connector is effected.

Figure 2:
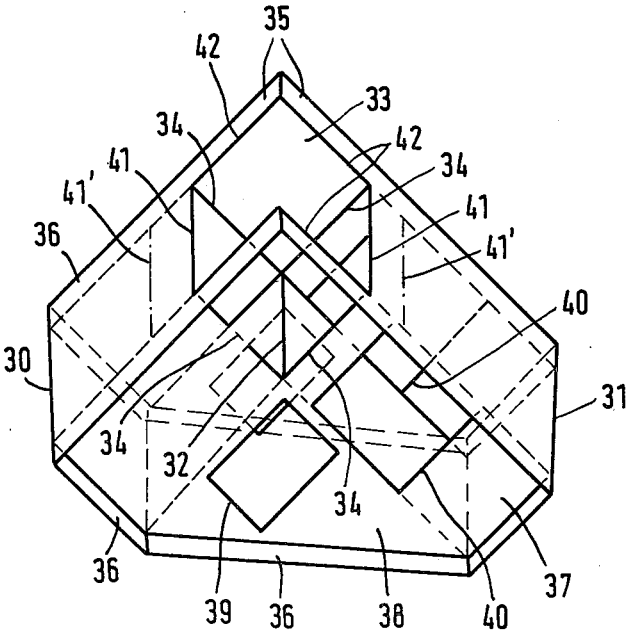
FIG. 2 shows a joint connection pursuant to the present invention according to which the rafters form an angle of 90° with one another.

As shown in FIG. 2, the sleeves 30 and 31, which form the openings for the rafters, are arranged at right angles to one another and are connected with one another at the edge 32 of the lower walls. This edge 32 at the same time forms an edge for the opening 33 arranged between the sleeves 30 and 31 and through which may be inserted the ridge beam, which is perpendicular to the rafters which are in the sleeves 30 and 31. The opening 33 is formed on the one hand by the edges 34 of the side walls 37 of the sleeves 30 and 31, and on the other hand by the flanges 35 which, with extensions 36, are arranged on the sleeves 30 and 31. The extensions 36 are formed as the rim which extends around the entire side surfaces of the joint connector. The side walls 37 are extended to form extensions 38 which bridge the space between the sleeves 30 and 31. The extensions 38 are also bordered by the extensions 36 of the flanges 35. An opening 39 is provided in each extension 38, in which connection the two openings 39 are aligned with one another and have a shape corresponding to the cross section of the beam which is to be inserted therein. In addition, openings 40 are respectively arranged in both side walls 37 of the sleeve 31 and are defined above and below by said walls 37. The openings 40 formed by the side walls 37 are large enough to accommodate the beam which is to be inserted therein.

The sleeves 30 and 31 and the opening 33 also constitute the main dimensions with this specific embodiment of the joint connector. The rafters are in the two sleeves 30 and 31, and the ridge beam is perpendicular thereto in the opening 33. Since the two sleeves 30 and 31 are open at both ends, a rafter may be inserted into a sleeve to such an extent that it projects to the other side across the opening 33. In such a case, of course, no ridge beam can any longer be inserted into the opening 33, but rather must be inserted into the openings 39 or the openings 40. If the openings 40 are used, a rafter can only be inserted into the sleeve 31 until it abuts the beam in the openings 40. It is even possible to place a beam having a cross section corresponding to that of the sleeves 30 or 31 into the connector transverse to the opening 33 in such a way that the beam rests upon the edges 41 of the upper side of the sleeves. In this connection, this edge 41 may also be offset with regard to the edges 34, as shown at 41'.

Figure 3:
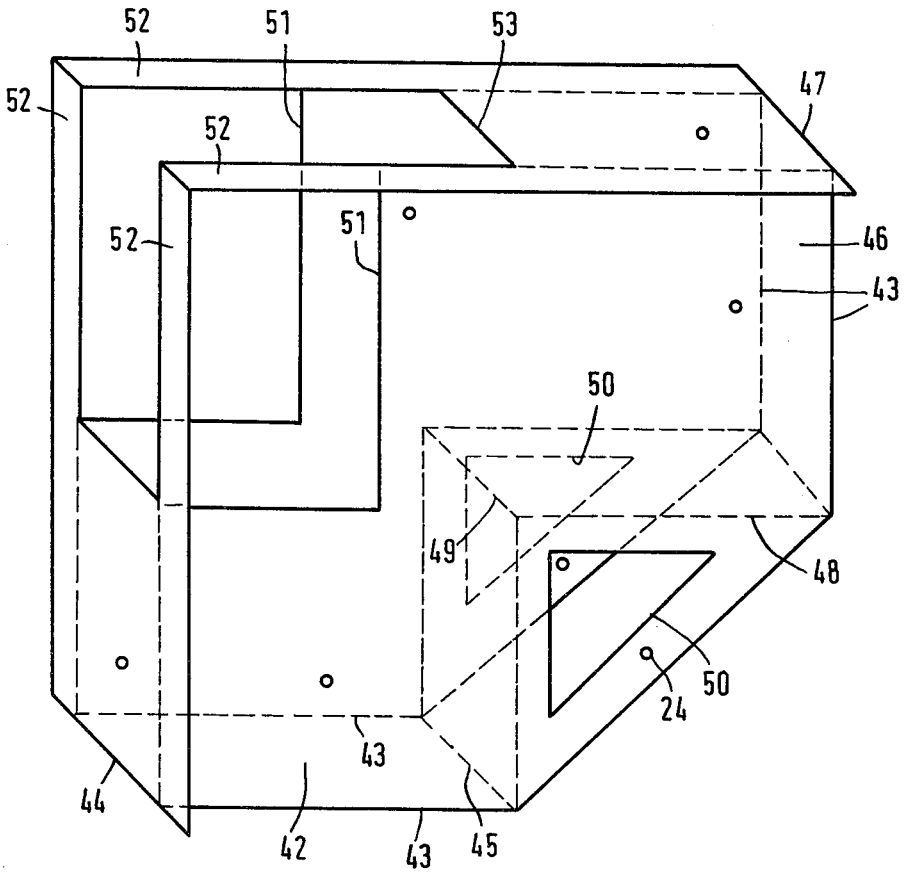
FIG. 3 shows a different embodiment of a joint connector pursuant to the present invention in which the rafters form an angle of 90° with one another.

With the construction shown in FIG. 3, the sleeve 42 is formed by the side walls 43, the upper wall 44, and the lower wall 45. The side walls 43 are enlarged to such an extent that together with the upper side wall 47 and the lower wall 48, they also form the side walls for the second sleeve 46 which is at right angles to the first sleeve 42. The two lower walls 45 and 48 form a common edge 49 and between them form the openings 50, the axis of the passage of which is perpendicular to the longitudinal direction of the sleeves 42 and 46. The openings 50 are designed for a beam having a triangular cross section. Two openings 51, which are provided for the ridge beam, are aligned with one another and define a passage, the axis of which is perpendicular to the side walls 43. The openings 51 are in addition bordered by the flanges 52. The edge 53 of the sleeve 46 is offset, so that a beam may be inserted transverse to the passage defined by the openings 51. In other respects the use of the individual openings is analogous to the previously described examples. There are thus extensive variation possibilities with the joint connector of the present invention. For example, the openings 40 of FIG. 2 may also be provided in both sleeves; or the cross sections of the additional openings 18, 39, 40 and 50 may all be different from one another. With a rectangular cross section, the position of the corners in relation to the sleeves or to the ridge beam may also be freely selected.

The space defined by the edge 41'' and sleeve 42 may be enlarged. The extensions 17 and 38 for the side walls 43 form a space open toward the outside into which may be inserted a beam as reinforcement which may be fastened with a nail at any desired angle. With the design of FIG. 1, the space is also open toward the top, so that in the position of the connector shown in the drawing, a beam may be inserted through the space perpendicular thereto, and, for example with nails, may be fastened at any desired angle. The connector may also be divided, or one of the openings may be reinforced by a sleeve H added from the outside.

It is, of course, to be understood that the present invention is by no means limited to the specific showing in the drawing, but also encompasses any modifications within the scope of the appended claims.

What I claim is:

1. A multiple-use joint connector made of any suitable material, including plastic, sheet metal, and wood, particularly for roof structures, which comprises:

two interconnected receiving sections each having two pairs of opposite side walls, said receiving sections being open at both ends and having their central longitudinal axes form an angle with one another while being located in a common plane, said receiving sections being adapted to respectively receive rafters, those end edges of the respective receiving sections which face each other defining a space of sufficient size to allow introduction of a ridge beam into said space at least transverse to said common plane, those corresponding pairs of said side walls of each of said receiving sections which are parallel to said common plane being provided with extensions for effecting said interconnection of said receiving sections, each of said extensions having at least one corresponding opening, each pair of corresponding openings of said extensions being aligned and adapted to receive one beam in such a way that said beam is transverse to said common plane; and flange means extending from at least one corresponding side wall of each of said receiving sections outwardly from and transverse to said common plane, said flange means being provided with extensions which are connected to said side wall extensions so as to confine same.

2. A joint connector accordng to claim 1, in which said receiving sections form sleeves.

3. A joint connector according to claim 1, in which said angle formed by said longitudinal axes is about 90°.

4. A joint connector according to claim 1, in which said angle formed by said longitudinal axes is about 130°.

5. A joint connector accordng to claim 1, in which at least one of those end edges of said receiving sections which face each other is in a different plane than the plane of those end edges adjacent thereto.

6. A joint connector according to claim 1, in which nail holes are provided in at least several of said side walls.

7. A joint connector according to claim 1, in which nail holes are provided in at least several of said side walls and in said flange means.

8. A joint connector according to claim 1, which is composed of two sections interconnected substantially along said common plane.

9. A joint connector according to claim 1, in which one of said side walls of each of said receiving sections is connectable after said joint connector is installed.

10. A joint connector accordng to claim 1, in which one side of each of said receiving sections is open.

11. A joint connector according to claim 1, in which reinforcing sleeves are inserted into at least one of said pairs of corresponding openings.

* * * * *